US006817042B1

(12) United States Patent
Stanneck

(10) Patent No.: US 6,817,042 B1
(45) Date of Patent: Nov. 16, 2004

(54) POOL COVER DRAIN

(76) Inventor: Eric Stanneck, 23 Birch Ridge Rd., Great Meadows, NJ (US) 07838

( * ) Notice: Subject to any disclaimer, the term of this patent is extended or adjusted under 35 U.S.C. 154(b) by 0 days.

(21) Appl. No.: 10/634,361

(22) Filed: Aug. 6, 2003

(51) Int. Cl.[7] ..... E04H 4/00
(52) U.S. Cl. ..... 4/498
(58) Field of Search ..... 4/498

(56) References Cited

U.S. PATENT DOCUMENTS

| | | | | | |
|---|---|---|---|---|---|
| 2,614,717 | A | | 10/1952 | Wiggins | 220/26 |
| 3,579,657 | A | | 5/1971 | Gurrieri | 4/172.12 |
| 3,690,502 | A | | 9/1972 | Guber, Jr. | 220/26 D |
| 3,757,812 | A | | 9/1973 | Duncan | 137/142 |
| 4,211,249 | A | * | 7/1980 | Richards | 137/393 |
| 4,214,671 | A | | 7/1980 | McKibbin et al. | 220/219 |
| 4,248,357 | A | | 2/1981 | Stafford | 220/219 |
| 4,318,421 | A | | 3/1982 | Ward | 137/135 |
| 4,561,134 | A | | 12/1985 | Mathews et al. | 4/496 |
| 4,633,899 | A | | 1/1987 | Lord | 137/357 |
| 4,819,681 | A | | 4/1989 | Hodak | 137/1 |
| 4,830,040 | A | | 5/1989 | Eng | 137/135 |
| 4,853,984 | A | | 8/1989 | Celiano | 4/496 |
| 5,343,888 | A | | 9/1994 | Stelzer | 137/135 |
| 5,802,629 | A | * | 9/1998 | Zietek | 4/498 |
| 5,946,743 | A | | 9/1999 | Hashmi | 4/498 |
| 6,260,217 | B1 | | 7/2001 | Loft, Jr. | 4/498 |
| 6,338,169 | B1 | | 1/2002 | DeGarie | 4/498 |
| 6,357,964 | B1 | | 3/2002 | DeGarie | 405/52 |
| 6,487,733 | B2 | | 12/2002 | Bonelli et al. | 4/498 |
| 6,497,533 | B2 | | 12/2002 | DeGarie | 405/52 |

* cited by examiner

*Primary Examiner*—Charles E. Phillips
(74) *Attorney, Agent, or Firm*—Ernest D. Buff & Associates, LLC; Ernest D. Buff; Dave Narasimhau

(57) ABSTRACT

A pool cover drain substantially completely drains collected rainwater without use of pumps or electrical hookups. The pool cover drain is non-centrally located in a pool cover. It is attached to a flexible hose that directs the water to a swimming pool sidewall drain outlet. A sealed weighted tubular element creates a conical depression in said swimming pool cover. The sealed weighted tubular element is placed atop the pool cover in close proximity to said pool cover drain. Collected rainwater is directed along the outside walls of the weighted tubular element, and into the pool cover drain. Sand weights on an end of the sealed weighted tubular element proximate the pool cover drain facility a gravity feed of collected rainwater into the pool cover drain. The sealed weighted tubular element is optionally provided with right-angled projections to prevent rolling and displacement thereof during high velocity wind gusts. A filter in the pool cover drain prevents clogging by debris and the like.

10 Claims, 3 Drawing Sheets

SECTION XX

SECTION XX

POOL COVER DRAIN

BACKGROUND OF THE INVENTION

1. Field of the Invention

The present invention relates to pool drains for above ground swimming pool covers, and more particularly, to an automatic drain that is easy to install, and functions with minimal hardware to effectively remove collected rain water and accumulated debris without stretching, straining or otherwise damaging the pool cover.

2. Description of the Prior Art

Many approaches have been proposed by prior art workers for removing rainwater accumulated over covers to container vessels including swimming pools. Many of the swimming pool cover drains require electric motor driven pumps. Gasoline and other chemical storage vessels with closed tops drain the rainwater using gravity flow through the inside of a lattice of pipes to a common location from which the rainwater is drained.

U.S. Pat. No. 2,614,717 to Wiggins discloses a floating tank roof. This floating tank roof floats over the liquid in a tank and captures rainwater and snow without sinking. A central portion attached to rigid rings drains rainwater into the periphery of the roof surrounding the central rigid ring. A limber bottom as well as the weight of water collected in the central portion maintains the tapered bottom of the periphery. This taper allows the water to be gravity drained through a pipe connected to the periphery. Alternately, the central region may also have a drain connection. The floating tank roof disclosed by Wiggins does not drain all collected rainwater, and does not suggest features required for a pool cover drain.

U.S. Pat. No. 3,579,657 to Gurrieri discloses a swimming pool cover drain. The rainwater collected above the swimming pool cover is pumped through a filter with the same pump used to circulate the swimming pool water. A floating ball sensor determines when the swimming pool cover is pumped out. When the swimming pool cover is completely pumped a valve shuts the inlet allowing normal circulation of swimming pool water. The draining of collected rainwater requires the circulating pump to run. Separate valve hardware is required to prevent rainwater from entering the pool water.

U.S. Pat. No. 3,690,502 to Guber, Jr. discloses a pipe containing an annular pontoon floating roof, which has high enough buoyancy to float on a hydrocarbon liquid surface in a tank. The edges of the annular pontoon seal against the tank sidewalls prevent entry of rainwater into the hydrocarbon tank. A central box channel provides structural rigidity to the annular pontoon and also acts as a draining element for collected rainwater collected, which increases the density of the pontoon and may submerge it below the surface of the hydrocarbon liquid. The collected water is drained through a flexible hose, which passes through the hydrocarbon liquid into a drain outlet located on the sidewall of the tank. The central box channel is connected to a parallel array of chordal pipes to provide additional structural rigidity. The annular pontoon roof disclosed by the '502 patent does not suggest a drain for swimming pool covers. The sealed floating pontoon moves according to the amount of rainwater collected, thereby presenting an arrangement that does not apply to swimming pool covers.

U.S. Pat. No. 3,757,812 to Duncan discloses a roof standing water eliminator. It is installed in a low area in the roof A float sensor detects accumulation of water and activates a pump. When the accumulated water is exhausted, the same float sensor shuts off the pump. This drainage system proposed by the '812 patent is not suitable for draining swimming pool covers. It requires a pump driven by an electrical motor that is turned on when sufficient rainwater is collected.

U.S. Pat. No. 4,214,671 to McKibbin et al discloses a floating roof drainage system. A central drain connects a plurality of welded pipes on the roof to drain accumulated rainwater. Sleeve type couplings provide a hinge-like motion between welded segments, so that the floating roof can be moved. The edge of the floating roof is sealed against the tank to prevent rainwater from entering the product stored in the tank. U.S. Pat. No. 4,248,357 to Stafford discloses a floating roof drain. The floating roof edge is sealed against the tank wall by a seal strip. The floating roof collects rainwater and drains it through a central drain, which is connected to a coiled conduit connecting the central drain of the floating roof with a drain located in the bottom of the tank. When all the content of the tank is emptied, the floating roof essentially contacts the bottom of the tank and a frustoconical contour of the bottom, together with a cylindrical portion, accommodates the central drain and the coiled conduit. The '671 and '357 patents disclose floating roof rainwater draining systems having sealed edges. Such systems are not suitable for use as a swimming pool cover drain.

U.S. Pat. No. 4,318,421 to Ward discloses a float controlled siphon valve for a swimming pool cover. A hinged float is used to sense the water level and open a closure of a siphon inlet. The closure of the siphon is accomplished by a male opening and a female closure manufactured from a softer material, which moves away from the male member when the water level in the swimming pool cover rises. When the water level drops, the float moves downwards, forcing the female member over the male inlet creating a seal for the siphon system. The siphon system drains the accumulated rainwater over the pool cover by gravity without need of pumps, or the like. Drainage of water accumulated over the swimming pool cover is incomplete, since the float must remain primed at all times, and closes the valve before all the collected rainwater has been drained. Moreover, moving parts in the '421 patent system may become clogged with debris accumulated over the swimming pool cover.

U.S. Pat. No. 4,819,681 to Hodak discloses an apparatus and method for draining a swimming pool cover. A central drainage passage in a completely covered swimming pool cover is associated with upper and lower flanged members, which seal around a hole formed in the pool cover. The drain is connected to an elbow, which connects to a drain outlet located in a sidewall of the swimming pool. A flexible bellowed connection associated with the elbow accommodates the vertical motion of the water level or the swimming pool cover. A fixed rainwater liquid level is maintained above the pool cover to assure that the pool cover stays in place. This is accomplished by locating the drainage hole adjustably above the swimming pool cover. At all times, the level of rainwater is maintained above the swimming pool cover at a preset level by adjusting the position of the central drainage hole above the pool cover. A single central bole in the pool cover coupled with a large head of rainwater stresses the polymeric material of the swimming pool cover. This stress may enlarge the large central hole by tearing. Alternatively, the weight of rainwater above the swimming pool cover may tear the polymeric pool cover at the edges where it is attached. Excessive rainwater weight may also cause the swimming pool cover to become submerged beneath the water level in the pool.

U.S. Pat. No. 4,830,040 to Eng discloses an automatic swimming pool cover drainer. A float connected to a lever arm opens an inlet to a siphon valve and quickly closes when the water level reaches a preset value. Drainage of the water in the siphon exit line is thereby prevented so that the siphon action is not broken. The siphon discharge line is always filled with water. Electrical or mechanical means may be used to reset a latch mechanism assisting siphon valve closure. Water is always present on the swimming pool cover. Consequently, the plastic material of the swimming pool cover has to bear the weight of water, together with the sensing and activating mechanisms of the automatic drainer. Moreover the device disclosed by the patent does not empty out the accumulated rainwater completely. Accumulated debris on the swimming pool cover may interfere with the lever mechanism and prevent the siphon from remaining in a primed condition.

U.S. Pat. No. 4,863,984 to Celiano discloses a system and method for maintaining a swimming pool cover drained of accumulated precipitation. A pump with its intake is disposed in the reservoir region above the swimming pool cover where the rainwater accumulates. The pump discharges the rainwater outside this region and has a fluid flow-monitoring sensor in the discharge line. A clock circuit turns on the pump for a 10-second period. If the flow sensor in the discharge tube detects rainwater, the pump stays on. When the flow switch no longer senses flow and shuts off, the pump is also turned off. An electrical motor and power line connections are required for operation of the system.

U.S. Pat. No. 5,802,629 to Zietek discloses a self-draining pool cover. The pool cover has a central aperture to which a drain fitting is connected. The pool cover is attached over the sides of the above ground swimming pool and the central drain fitting in the swimming pool cover is connected to a first hose, which drains the collected rainwater by creating a conical depression in the swimming pool cover. The first hose is placed within the swimming pool water and is connected to a second fitting attached to the sidewall of the swimming pool. A second hose connected to this second fitting external to the above ground swimming pool drains away the rainwater. In order for the central drain to drain the collected rainwater, a conical depression must first be created. This depression is created by taut attachment of the swimming pool cover to the sides of the swimming pool and attachment of a hose disposed within the swimming pool water that is attached to a drain fitting in the sidewall of the swimming pool. The hose must be pulled taut to create the required conical depression. This results in high stress within the hose. A drain fitting proximate the hose pulls the plastic swimming pool cover; creating a large aperture in the plastic sheet, which can tear easily. Displacement of water due to the depression created within the swimming pool cover creates additional stresses thereon.

U.S. Pat. No. 5,946,743 to Hashmi discloses a self-draining pool cover. A central aperture in a swimming pool cover attached over the sides of a swimming pool is fitted with a collar to accept a hose. The collar is sealed water tight against the swimming pool cover by use of a rubber grommet. The hose connected to the collar drains the collected rainwater to the skimmer of the pool. This draining action requires that the collar be located at an elevated location, compared to the skimmer. Since the skimmer is at the same level as the general water level in the swimming pool, the pool cover has to essentially float above the water line. To achieve this floating action, the pool cover must be stretched taut Inasmuch as the central aperture is a large opening, stretching of the pool cover can cause it to tear.

U.S. Pat. No. 6,260,217 to Loft, Jr. discloses a winter swimming pool cover and draining device. The swimming pool cover has a central aperture. A tube having slots in the upper portion is attached to the swimming pool cover using a threaded connection and gaskets to create a watertight seal between the tube and the swimming pool cover. The bottom of the tube is connected to an elbow which, in turn, is connected to a flexible hose conduit. The other end of the flexible hose conduit is attached to a sidewall of the above ground swimming pool below the water line. Rainwater drains through slots in the tube into the flexible hose conduit, and is discharged through a fitting attached to the sidewall of the pool. Since the tube is attached to the elbow and flexible hose conduit, it is not rigid. Consequently it is very difficult to locate and align the aperture of the swimming pool cover with the slotted tube. In addition, the threaded device with gasket must be tightened at the same time that the pool cover is attached firmly to the sidewalls of the aboveground swimming pool. The large aperture in the swimming pool cover may tear due to the stresses required by these multiple, complex, and unwieldy operations.

U.S. Pat. No. 6,338,169, U.S. Pat. No. 6,357,964 and U.S. Pat. No. 6,497,533 to DeGarie disclose a floating cover for large reservoirs. Means are provided for covering the top free surface of the liquid and for accommodating the up and down motion of the top surface according to the liquid level within the reservoir. A floating grid is anchored to the perimeters of the walls of the reservoir. The grid floats over the liquid surface due to its buoyancy. A water impermeable membrane is affixed to the perimeter walls and is loosely laid over the floating grid. An array of weights anchored to the wall is placed over the water impermeable membrane in between the free spaces of grid beams. Accumulated rainwater behaves in a fashion similar to the weights, and keeps the membrane taut. Drain holes at many locations 60 are provided in the water impermeable membrane for draining collected rainwater through interconnected fittings, which terminate a common drain. Side to side movement is anticipated for the perimeter-anchored membrane, as the liquid level in the reservoir is changed. This movement may interfere with beam and weight locations, snagging the drain holes and the drain connections with the beam. The disclosure does not elaborate how the drain holes function when the liquid level is changed. Any rainwater creates 'puddles', which tend not to create a well-formed valley located near the drain holes. No disclosure is contained by these patents concerning a drain for pool covers.

U.S. Pat. No. 6,487,733 to Bonelli et al discloses a self-draining swimming pool cover. The swimming pool cover consists of two layers. A top layer, which is a screen portion, prevents entry of debris. The bottom layer is the swimming pool cover. The bottom layer has a central aperture through which a drain fitting is attached. The drain fitting has a gasket, which seals the swimming pool cover against the fitting. The drain fitting is attached to a conduit, which may be a flexible hose, submerged in the swimming pool water connected to a drain fitting attached to a sidewall of an above ground swimming pool. A buoyant ring having a circular cross section joins the top and bottom layers, acting as a barrier. The single aperture is a large hole, so that stretching of the swimming pool cover applies stresses that may tear the central aperture. The buoyant ring prevents formation of a depression at the drain unless the drain physically pulls down the bottom layer; and this cannot readily occur, since the conduit is flexible. If the screen is taut, the bottom layer simply floats above the water level carrying the drain.

There remains a need in the art for a low cost, reliable, easy to use pool cover drain that is easy to attach and drains the collected rainwater completely as soon as it is collected without use of pumps, motors and electrical hook ups. The device must drain the collected rainwater completely, since any accumulation of rainwater applies stress to the polymeric pool cover sheet and will lead to eventual tearing of the pool cover.

SUMMARY OF THE INVENTION

The present invention provides a pool cover drain that is inexpensive to manufacture, easy to install and maintain, and highly reliable in operation. It can be installed at any time as long as the pool water is not frozen, and is readily adapted to facilitate drainage of an existing pool cover. The pool cover drain of the present invention readily collects substantially all rainwater deposited on the pool cover surface and channels the collected water away from the pool cover without use of pumps, motors and electrical hook ups. Substantially complete drainage of water and debris atop the pool cover is achieved without application of undue stress to the polymeric pool cover sheet; tearing and undue stretching of the pool cover is virtually eliminated.

Generally stated, a single drain is located in the pool cover. The drain is displaced from the center of the pool cover sheet by approximately three quarters of the radius thereof. One side of a flexible hose is attached to the drain. The other side of the flexible hose is connected to the sidewall of the swimming pool, and functions as a drainpipe to facilitate removal of collected rainwater through the swimming pool sidewall. The polymeric pool cover is placed over and attached to the swimming pool sides in the usual manner. A sealed weighted tubular element, preferably weighted by sand on one side, is placed in close proximity to the pool cover drain. The weighted tubular element depresses the pool cover, creating a conical depression that enables collected rainwater to readily run downwardly adjacent the sealed tubular element and, optionally, through interior portions thereof, and into the drain.

Due to the displaced location of the drain in the pool cover and the conical depression caused by the use of the weighted sealed tubular element, substantially all collected rainwater is rapidly removed, even in heavy rain downpours. Right-angled sand-filled protrusions at one end of the sealed weighted tubular element may be used advantageously to prevent rolling of the sealed tubular element over the pool cover, especially during heavy wind gusts. Optionally, a filter may be placed over the pool cover drain to prevent clogging thereof by leaves, branches, lawn clippings and other garden debris.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

The present invention provides a pool cover drain that is installed with minimal hardware and effectively drains any collected rainwater completely. The pool cover drain drains rainwater completely even in heavy rain downpours rainwater does not accumulate over the swimming pool cover and the stress to the polymeric sheet of pool cover is greatly reduced preventing tears, enhancing pool cover service life. A single drain nipple is provided on the polymeric swimming pool cover at a radial distance of approximately three-quarters from the center. A flexible hose has one end attached to a drain on the sidewall of the above ground swimming pool. The other end of the hose attached to the drain nipple when the swimming pool cover is placed over the swimming pool. Next, the edges of the pool cover with the attached pool cover drain and flexible hose connection is firmly placed and anchored over the sides of the above ground swimming pool in the usual manner. A sealed weighted tubular element having its weight placed primarily on one end is placed so that the weighted end is in close proximity with the pool cover drain. This depresses the pool cover into a conical depression, directing the collected rainwater into the pool cover drain. When rainwater is collected over the swimming pool cover, it runs down the conical depression in the pool cover to the pool cover drain and the water travels on the outside of the sealed weighted tubular element. Optionally the construction of the weighted tubular element may be such that the rainwater may flow through the center of the pipe as well. In a preferred embodiment, the sealed weighted tubular element may have right-angled protrusions on one end. The protrusions are filled with sand. Protrusions at right angles prevent the sealed weighted tubular element from rolling even when wind gusts are present. The right-angled protrusions locate the sand filled, weighted end portions of the sealed weighted tubular element in close proximity with the pool cover drain, enabling the system to maintain a proper rainwater-draining configuration. Due to the conical depression caused by the sealed weighted tubular element, the rainwater readily runs down into the drain with minimal accumulation even during heavy rain downpours. Accumulation of rainwater over the swimming pool cover is substantially prevented; strains and tears in the polymeric pool covers are minimized and the in-service life of the pool cover is significantly increased.

Figure 1:
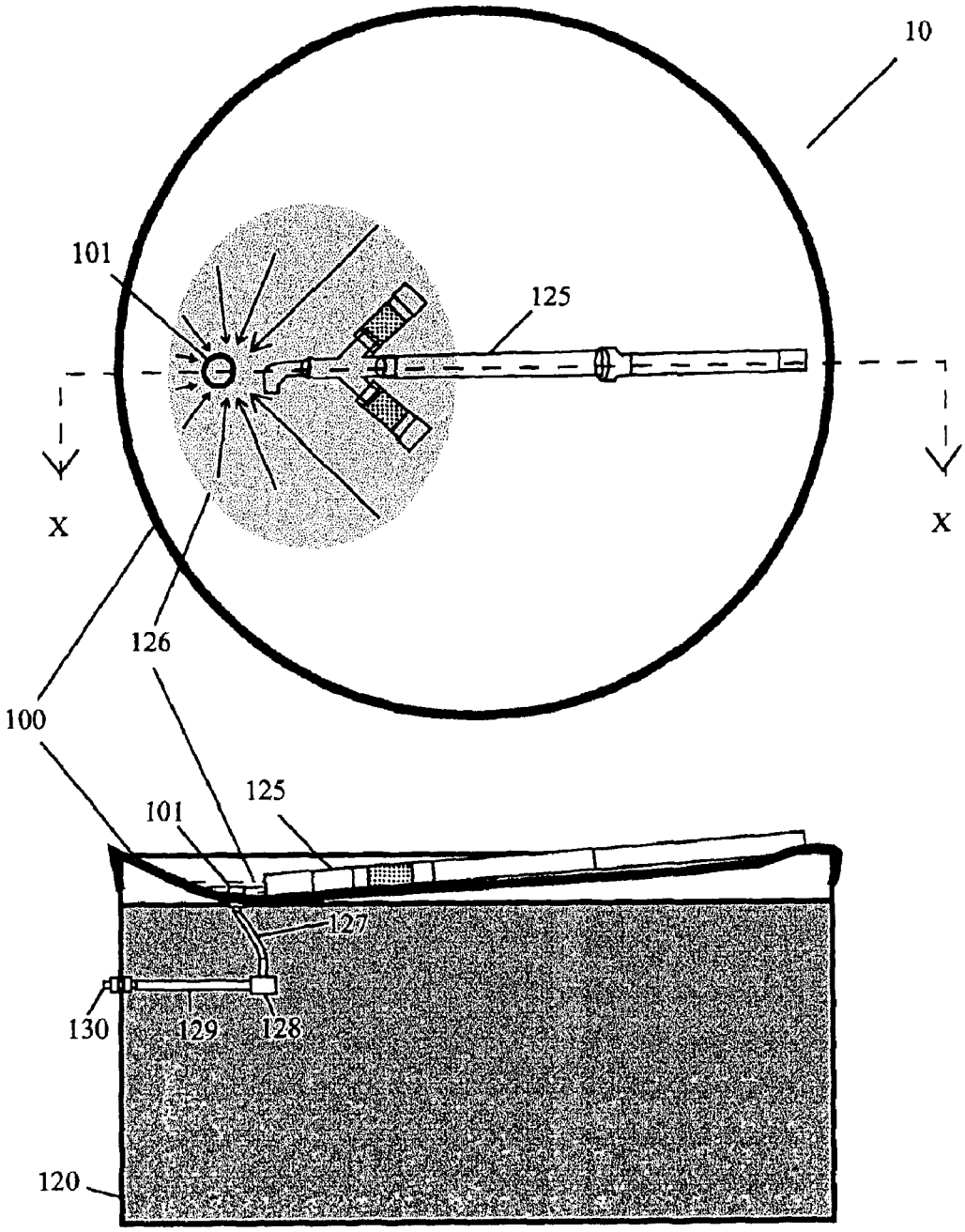
FIG. 1 is a schematic diagram of the pool cover drain 10 with pool cover 100 placed over an above ground swimming pool 120 and a pool cover drain 101 drains the collected rainwater through existing water outlet drain 130 located in the sidewall of the pool well below the water line due to action of the sealed weighted tubular element 125.

In FIG. 1 there is shown generally at 10 a schematic diagram of a pool cover having a section taken along the line XX. An above ground swimming pool 120 has a pool cover 100 placed over it, and carries a pool cover drain 101 in a non-centric location. The pool cover drain is located approximately three-quarters of the radius from the center of the pool cover, as shown. When a pool cover is installed, a flexible hose 127 is attached to the pool cover drain 101 and the pool cover is placed over the sides of the swimming pool and anchored in the usual manner. The other end of the flexible hose is connected to a union 128 connected to a flexible pipe 129 that is attached to a drain outlet 130 located on the sidewall of the swimming pool, well below the water line. When the pool cover is not in place, the water port 130 is capped or connected through external hosing to the pool filtering system (not shown) thereby preventing water from draining out of the swimming pool. FIG. 1 illustrates use of a sealed weighted tubular element 125 with its two right-angular projections carrying sand for depressing the swimming pool cover to create a conical depression towards the drain. These right-angular projects prevent rolling of the sealed weighted tubular element in wind gusts and keeps the sand weighted portion of the sealed weighted tubular element on close proximity with the pool cover drain, thus maintaining the conical depression necessary for efficient draining of collected rainwater. The flow of collected rainwater to the drain 101 is indicated by arrows. Collected rainwater runs outside the sealed tubular element into the pool cover drain due to the conical depression formed in the pool cover 100.

Figure 2:
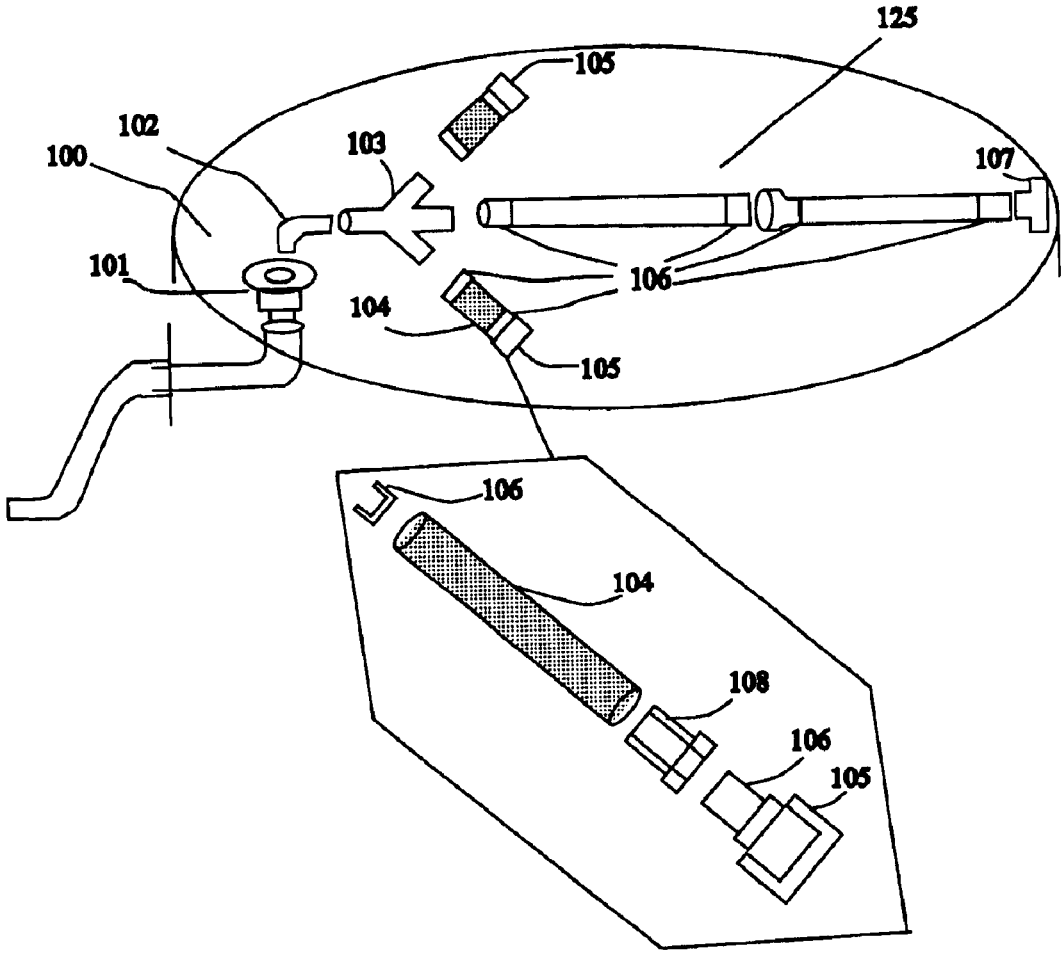
FIG. 2 is a schematic diagram depicting construction details for the sealed weighted tubular element 125 placed over the swimming pool cover.

In FIG. 2 there are shown construction details for the sealed weighted tubular element 125. The element 125 is composed of PVC tubing with internal plugs 106 and a T section 107. A PVC tube element is connected to the central port of a double Y element 103. Two sand filled elements 105 are connected to the side ports of the double Y element 103. Construction details of the sand filled elements 105 are shown by FIG. 2 in the exploded view. The sand filled portion is a PVC tube approximately 2 feet long comprising a plug on one side and a threaded plug with a central hole on the other side to assist sand filling. When sand is filled, the central hole is also plugged, as shown, and the end is capped. The fourth central port of the double Y element 103 is connected to a street elbow. The assembled sealed tubular element is watertight and does not roll readily, due to the two right-angled projections, street-elbow and T end cap. These two sand filled, right-angled projections provide sufficient weight to hold the tubular element firmly against the top of pool cover 100, thereby enabling the system to maintain a proper rainwater-draining configuration.

Figure 3:
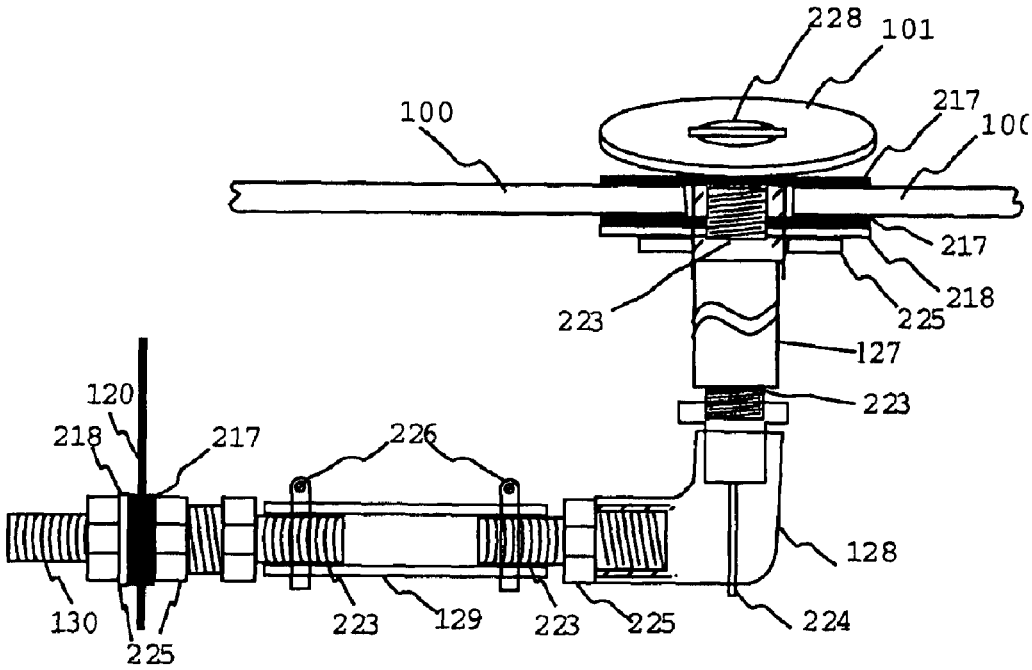
FIG. 3 is a schematic diagram depicting additional details of the pool cover drain 101, its attachment to the swimming pool cover 100, the attachment of flexible hose 127 to the drain 101, and attachment of flexible hose 127 connection to the side wall of the swimming pool.

In FIG. 3 there are shown details of the connection of the flexible hose 127 to pool cover drain 101 and its connection to the drain 130 on the sidewall of the above ground swimming pool. The pool cover drain may have a debris filter 228 installed on it to prevent entry of debris into the drain and may be in the form of fine wire mesh or a replaceable filter element. The swimming pool cover 100 has a hole to receive the pool cover drain 101. Two gaskets 217 are placed on either side of the pool cover, and a nut 225 is tightened against a washer 218 to create a waterproof seal. A flexible hose 127 is inserted during the assembly of the pool cover as described previously, by slipping the flexible hose 127 over a barbed nipple 223. The other end of the flexible hose is connected to another barbed nipple at 223, which is attached to an elbow at 126. The elbow may have hose retaining fixtures at 224. The other end of the elbow is connected to another barbed nipple 223, over which a flexible hose 129 is attached. Hose clamp 226 secures the hose 129. The other end of the hose 129 is attached to a nipple 223 attached to the sidewall of the swimming pool, and is held in place by hose clamp 226. The attachment of the drain outlet 130 to the swimming pool wall is similar to the attachment of pool cover drain to the pool cover 100. It uses two gaskets 217 on either side of the sidewall of the swimming pool and nuts 225 and washer 218 to create a watertight seal. The drain outlet terminates outside the swimming pool on the sidewall at 130. All these connection elements may be made from standard PVC components and the flexible hoses may be rubber or other polymeric tubing.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A pool cover drain for an above ground swimming pool, comprising:

a. a pool cover placed over said above ground swimming pool having disposed in a non-centric portion thereof a sealed, watertight pool cover drain;

b. attachment means for connecting a flexible hose to said pool cover drain and to a side wall drain in said swimming pool, for draining collected rainwater away from said pool cover;

c. sealed, weighted tubular element means disposed on said pool cover adjacent said water tight pool cover drain, for creating a depression in said pool cover with a low point contiguous to said pool cover drain to thereby direct collected rainwater on said pool cover along outside portions of said element means and into said pool cover drain; and d. said sealed, weighted tubular element comprising right angled weighted projections in one end to prevent rolling and displacement of said sealed weighted element over said pool cover.

2. A pool cover drain as recited by claim 1, wherein said pool cover is composed of a polymeric material.

3. A pool cover drain as recited by claim 1, wherein said pool has a substantially circular shape, and said pool cover drain is disposed in said pool cover and displaced from a central portion thereof by a length of about three quarters of its radius.

4. A pool cover drain as recited by claim 1, wherein the said pool cover drain is attached to said pool cover with gaskets, a washer and a nut to create a water tight seal between said pool cover drain and said pool cover.

5. A pool cover drain as recited by claim 1, wherein the said attachment means for connecting said flexible hose to said pool cover drain comprises a plurality of barbed fittings.

6. A pool cover drain as recited by claim 1, wherein the said attachment means for connecting said flexible hose to said swimming pool sidewall drain comprises a plurality of barbed fittings.

7. A pool cover drain as recited by claim 1, wherein the said depression creation means creates a conical depression in said pool cover to direct rain water to said pool cover drain and comprises a sealed weighted tubular element with its weighted end placed in proximity with said pool cover drain.

8. A pool cover drain as recited by claim 7, wherein said sealed weighted tubular element comprises sand contained in said weighted end.

9. A pool cover drain as recited by claim 1, wherein said sealed weighted tubular element comprises sand contained within said right-angled projections.

10. A method for draining rainwater collected over an above ground swimming pool cover, comprising the steps of:

a. forming a sealed pool cover drain within a non-centrally located portion of said pool cover;

b. attaching a flexible hose to said pool cover drain, so that one side of said flexible hose is connected to a water outlet drain in the side wall of said above ground swimming pool below a water line, and the other side of said flexible hose is connected to a nipple on said pool cover drain;

c. placing the cover, together with said pool cover drain and said flexible hose attachment, over each side of said above ground swimming pool;

d. placing a sealed weighted tubular element with its weighted end in close proximity to said pool cover drain to create a conical depression in said swimming pool cover, so that collected rainwater runs along said sealed weighted tubular element and, optionally, through interior portions thereof, and into said pool cover drain said sealed weighted tubular element comprising right in one end, to prevent rolling and displacement of said sealed weighted element over said pool cover; and e. draining said collected rainwater from said pool cover drain to said sidewall drain outlet through a flexible hose.

* * * * *